US008487969B2

(12) United States Patent
Lim

(10) Patent No.: US 8,487,969 B2
(45) Date of Patent: Jul. 16, 2013

(54) ORGANIC LIGHT EMITTING DIODE DISPLAY AND METHOD FOR COMPENSATING CHROMATICITY COORDINATES THEREOF

(75) Inventor: Homin Lim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 237 days.

(21) Appl. No.: 12/974,023

(22) Filed: Dec. 21, 2010

(65) Prior Publication Data

US 2011/0292087 A1 Dec. 1, 2011

(30) Foreign Application Priority Data

May 27, 2010 (KR) ..... 10-2010-0049607

(51) Int. Cl.
*G09G 5/10* (2006.01)

(52) U.S. Cl.
USPC ..... 345/690; 345/76; 345/77

(58) Field of Classification Search
USPC ..... 345/690, 76–89; 315/169.3
See application file for complete search history.

(56) References Cited

U.S. PATENT DOCUMENTS

| | | | | |
|---|---|---|---|---|
| 2004/0113875 | A1* | 6/2004 | Miller et al. | 345/82 |
| 2006/0256053 | A1* | 11/2006 | Baek | 345/88 |
| 2007/0171218 | A1* | 7/2007 | Hong et al. | 345/211 |
| 2007/0182682 | A1* | 8/2007 | Hong et al. | 345/88 |
| 2008/0150850 | A1* | 6/2008 | Park et al. | 345/83 |
| 2008/0198180 | A1* | 8/2008 | Langendijk | 345/690 |
| 2009/0041348 | A1* | 2/2009 | Someya et al. | 382/167 |

* cited by examiner

*Primary Examiner* — Koosha Sharifi-Tafreshi
(74) *Attorney, Agent, or Firm* — Morgan, Lewis & Bockius LLP

(57) ABSTRACT

An organic light emitting diode display comprises a display panel, a data operation unit, a gain adjusting unit, and a data conversion unit. The display panel comprises an R sub-pixel, a G sub-pixel, a B sub-pixel, and a W sub-pixel. The data operation unit generates a data operation value. The gain adjusting unit generates a gain adjusting value of the three primary color data. The data conversion unit generates four color compensation data, whose white chromaticity coordinates are compensated for each pixel.

14 Claims, 8 Drawing Sheets

| Gray | L | x | y |
|---|---|---|---|
| 255 | 200 | 0.303 | 0.357 |
| 223 | 147 | 0.308 | 0.362 |
| 191 | 105 | 0.313 | 0.367 |
| 159 | 70.5 | 0.319 | 0.374 |
| 127 | 43.7 | 0.328 | 0.385 |
| 95 | 22.9 | 0.343 | 0.401 |
| 63 | 9.09 | 0.366 | 0.428 |
| 31 | 1.92 | 0.401 | 0.472 |

Trget(x, y) = (0.290, 0.300)

| Gray | R | G | B |
|---|---|---|---|
| 224~255 | 56 | 0 | 119 |
| 192~223 | 52 | 0 | 124 |
| 160~191 | 49 | 0 | 133 |
| 128~159 | 45 | 0 | 145 |
| 96~127 | 43 | 0 | 166 |
| 64~95 | 43 | 0 | 204 |
| 32~63 | 49 | 0 | 253 |
| 0~31 | 0 | 0 | 255 |

| Gray | L | x | y |
|---|---|---|---|
| 224~255 | 200 | 0.29 | 0.299 |
| 192~223 | 147 | 0.29 | 0.3 |
| 160~191 | 104 | 0.29 | 0.299 |
| 128~159 | 69.8 | 0.29 | 0.299 |
| 96~127 | 41.8 | 0.29 | 0.299 |
| 64~95 | 22.8 | 0.289 | 0.297 |
| 32~63 | 9.3 | 0.29 | 0.299 |
| 0~31 | 1.92 | 0.353 | 0.409 |

Trget(x, y) = (0.290, 0.300)

| Gray | R | G | B |
|---|---|---|---|
| 224~255 | 56 | 0 | 119 |
| 192~223 | 52 | 0 | 124 |
| 160~191 | 49 | 0 | 133 |
| 128~159 | 45 | 0 | 145 |
| 96~127 | 43 | 0 | 166 |
| 64~95 | 43 | 0 | 204 |
| 32~63 | 49 | 0 | 253 |
| 0~31 | 0 | 0 | $121*2^2$ |

| Gray | L | x | y |
|---|---|---|---|
| 224~255 | 200 | 0.29 | 0.299 |
| 192~223 | 147 | 0.29 | 0.3 |
| 160~191 | 104 | 0.29 | 0.299 |
| 128~159 | 69.8 | 0.29 | 0.299 |
| 96~127 | 41.8 | 0.29 | 0.299 |
| 64~95 | 22.8 | 0.289 | 0.297 |
| 32~63 | 9.3 | 0.29 | 0.299 |
| 0~31 | 1.95 | 0.288 | 0.304 |

ORGANIC LIGHT EMITTING DIODE DISPLAY AND METHOD FOR COMPENSATING CHROMATICITY COORDINATES THEREOF

This application claims the benefit of Korea Patent Application No. 10-2010-0049607 field on May 27, 2010, which is incorporated herein by reference for all purposes as if fully set forth herein.

BACKGROUND

1. Field

This document relates to an organic light emitting diode display and a method for compensating the chromaticity coordinates thereof.

2. Related Art

An active matrix type organic light emitting diode display (AMOLED) is attracting a lot of attention as a next generation display because of advantages of fast response speed, high light emission efficiency, high luminance, and wide viewing angle. The organic light emitting diode display displays an image by controlling a current, flowing in an organic light emitting diode (hereinafter, OLED) by using a thin film transistor (hereinafter, referred to as "TFT").

A typical organic light emitting diode display has a plurality of pixels, each comprising an R (red) sub-pixel, a G (green) sub-pixel, and a B (blue) sub-pixel for full-color displays. An R emission layer EML for generating red light is formed in the OLED of the R sub-pixel, a G emission layer for generating green light is formed in the OLED of the G sub-pixel, and a B emission layer for generating blue light is formed in the OLED of the B sub-pixel. An emission layer is deposited separately for each sub-pixel by a fine metal mask (FMM) method using a metal mask, etc. However, the larger the size of the substrate, the more the mask is bent. Thus, the conventional deposition method using a metal mask decreases yield because it makes it difficult to precisely pattern an emission layer. As a result, it is hard to apply this method to large area and high precision displays.

As such, in recent years, the technology of implementing a color display device using a white OLED is emerging which does not require the use of a metal mask during the formation of an emission layer in an organic light emitting diode display. The white OLED has a structure in which an R emission layer, a G emission layer, a B emission layer, etc. are optionally laminated between a cathode and an anode. The white OLED is formed for each sub-pixel. This organic light emitting diode display has a plurality of pixels, each comprising an R sub-pixel, a G sub-pixel, a B sub-pixel, and W (white) sub-pixel for color displays. The R sub-pixel comprises an R color filter for transmitting red light among white light incident from the white OLED, the G sub-pixel comprises a G color filter for transmitting green light among white light incident from the white OLED, and a B color filter for transmitting blue light among white light incident from the white OLED. The W sub-pixel has no color filter, and transmits entire white light incident from the white OLED to compensate for a decrease in image luminance caused by the color filters.

Such an organic light emitting diode display generates W data based on R data, G data, and B data input from the outside, and modulates the R data, the G data, and the B data using the generated W data. The W data, the modulated R data, the modulated G data, and the modulated B data are respectively displayed in the W, R, G, and B sub-pixels.

The aforementioned conventional art was proposed under the assumption that the chromaticity coordinates of the white OLED are uniform. However, in reality, the white OLED displays a white color by a combination of emission layers of several colors. Thus, color changes vary according to the driving voltage of the material used, and this disturbs the color balance of white. This leads to a shift in white chromaticity coordinates for each gray level when emitting only W sub-pixels in the conventional art.

For example, in a panel where target values of the chromaticity coordinates (x, y) are set to (0.290, 0.300), the chromaticity coordinates (x, y) of a target luminance L for each gray level are different from the target values (0.290, 0.300) given in FIG. 1 due to the device characteristics of the white OLED. In particular, the degree of a shift becomes larger toward low gray levels as shown in FIG. 2, thus causing a yellowish phenomenon in low gray levels. There is a demand for a method for preventing the distribution of white chromaticity coordinates for each gray level and converging them to predetermined target values, as shown in FIG. 3, in an organic light emitting diode display using a white OLED.

SUMMARY

The present invention has been made in an effort to provide an organic light emitting diode display, which can compensate for deviations in the characteristics of white chromaticity coordinates for each gray level in the organic light emitting diode display comprising a white OLED.

To achieve the above advantages, one exemplary embodiment of the present invention provides an organic light emitting diode display, comprising: a display panel on which a plurality of pixels are arranged, each of the pixels comprising an R sub-pixel for generating red light through a white OLED and an R color filter, a G sub-pixel for generating green light through a white OLED and a G color filter, a B sub-pixel for generating blue light through a white OLED and a B color filter, and a W sub-pixel for generating white light through a white OLED; a data operation unit for generating a data operation value by extracting a representative value for each pixel based on three primary color data, determining white data of the corresponding pixel as the representative value, and then subtracting the white data from the three primary color data for each pixel; a gain adjusting unit for generating a gain adjusting value of the three primary color data by multiplying a preset gain value of the three primary color data by the corresponding white data; and a data conversion unit for generating four color compensation data, whose white chromaticity coordinates are compensated for each pixel, by adding the gain adjusting value to the data operation value and matching the corresponding white data to the three primary color data converted by the adding.

The gain adjusting unit generates a gain adjusting value for each gray level or for each predetermined gray level intervals with reference to the gain value set for the gray level or for the gray level interval.

The gain value is defined as a value for converging white chromaticity coordinates for each gray level or for each gray level interval to a predetermined target value in accordance with the white data.

The representative value is extracted as the gray level value of minimum data of the three primary color data.

In a predetermined low gray level interval, the number of bits of the gain value data becomes larger than the number of bits of representable data.

The remaining bits of the white data after allocation to the low gray level interval are additionally allocated to increase the gain value in the low gray level interval.

The organic light emitting diode display further comprises a first gain adjusting unit for primarily compensating the white chromaticity coordinates of the three primary color data by multiplying a preset first gain value by the three primary color data, and supplying the same to the data operation unit.

The organic light emitting diode display further comprises a gamma conversion unit for gamma-converting the three primary color data using a preset gamma curve and outputting the same to the data operation unit, and for inverse-gamma-converting and outputting the four color compensation data.

One exemplary embodiment of the present invention provides a method for compensating the chromaticity coordinates of an organic light emitting diode display comprising a plurality of pixels are arranged, each of the pixels comprising an R sub-pixel for generating red light through a white OLED and an R color filter, a G sub-pixel for generating green light through a white OLED and a G color filter, a B sub-pixel for generating blue light through a white OLED and a B color filter, and a W sub-pixel for generating white light through a white OLED, the method comprising: generating a data operation value by extracting a representative value for each pixel based on three primary color data, determining white data of the corresponding pixel as the representative value, and then subtracting the white data from the three primary color data for each pixel; generating a gain adjusting value of the three primary color data by multiplying a preset gain value of the three primary color data by the corresponding white data; and generating four color compensation data, whose white chromaticity coordinates are compensated for each pixel, by adding the gain adjusting value to the data operation value and matching the corresponding white data to the three primary color data converted by the adding.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Hereinafter, an implementation of this document will be described in detail with reference to FIGS. 4 to 16.

Figures 1, 2:
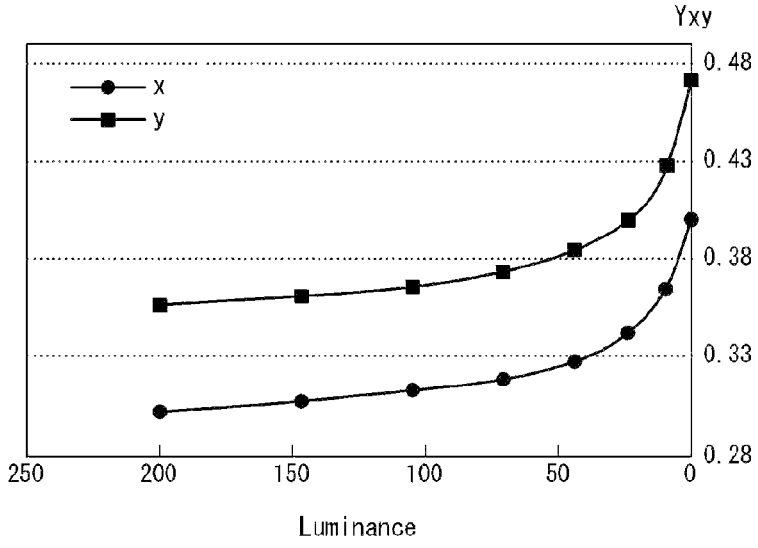
FIG. 1 (RELATED ART)
FIG. 2 (RELATED ART)
FIG. 1 is a view showing color characteristics for each gray level of a white OLED device.
FIGS. 2 and 3 are views showing changes in the chromaticity coordinates of the white OLED device.
Figure 3:
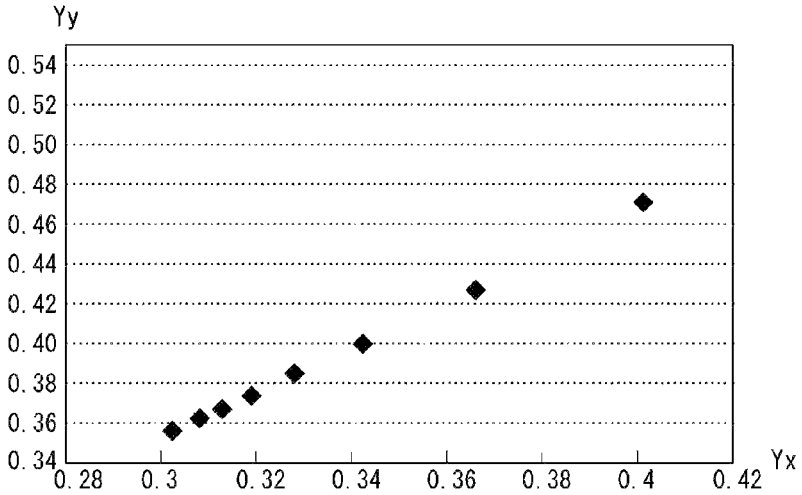
FIG. 3 (RELATED ART)
Figure 4:
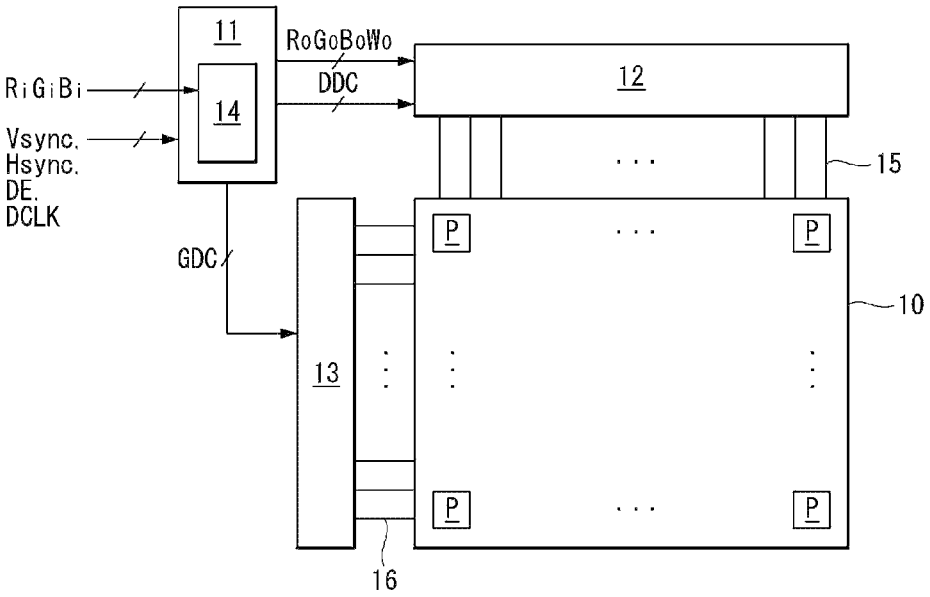
FIG. 4 shows an organic light emitting diode display according to an exemplary embodiment of the present invention.
Figure 5:
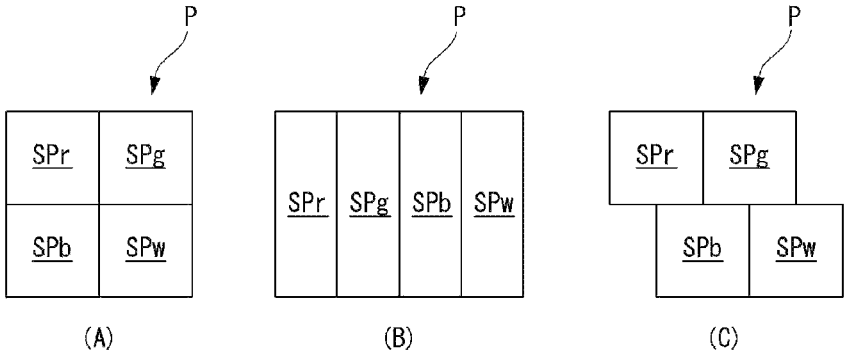
FIG. 5 shows various array patterns of sub-pixels in one pixel.

FIG. 4 shows an organic light emitting diode display according to an exemplary embodiment of the present invention. FIG. 5 shows various array patterns of sub-pixels in one pixel, and FIG. 6 shows a laminated configuration of sub-pixels in one pixel.

Figure 6:
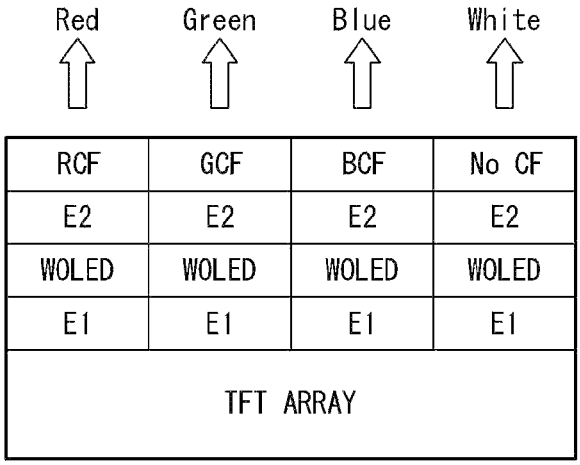
FIG. 6 shows a laminated configuration of sub-pixels in one pixel.

Referring to FIGS. 4 to 6, this organic light emitting diode display comprises a display panel 10, a timing controller 11, a data drive circuit 12, a gate drive circuit 13, and a chromaticity coordinate compensation circuit 14.

In the display panel 10, a plurality of data lines 15 and a plurality of gate lines 16 cross each other, and pixels P each comprising four sub-pixels SPr, SPg, SPb, and SPw are arranged in pixel areas defined by the crossings thereof. A pixel P comprises an R sub-pixel SPr for generating R (red) light, a G sub-pixel SPg for generating G (green) light, a B sub-pixel SPb for generating B (blue) light, and a W sub-pixel SPw for generating W (white) light for full color displays. The sub-pixels in one pixel P may form a checkerboard pattern by the crossings of two data lines and two gate lines as shown in (A) of FIG. 5, and may form a stripe pattern by the crossings of four data lines and one gate line as shown in (B) of FIG. 5. Moreover, the sub-pixels in one pixel P may form a checkerboard pattern by the crossings of two data lines and two gate lines as shown in (C) of FIG. 5, and the sub-pixels SPr and SPg of an upper row and the sub-pixels SPb and SPw of a lower row may be arranged so as to deviate from each other.

Each of the sub-pixels SPr, SPg, SPb, and SPw comprises a white OLED which does not require the use of a metal mask during the formation of an emission layer. The white OLED has a structure in which an R emission layer, a G emission layer, a B emission layer, etc. are optionally laminated between a cathode and an anode. The white OLED is formed for each sub-pixel. As shown in FIG. 6, the R sub-pixel SPr comprises an R color filter RCF for transmitting red light among white light incident from the white OLED, the G sub-pixel SPg comprises a G color filter GCF for transmitting green light among white light incident from the white OLED, and the B sub-pixel SPb comprises a B color filter BCF for transmitting blue light among white light incident from the white OLED. The W sub-pixel has no color filter, and transmits entire white light incident from the white OLED to compensate for a decrease in image luminance caused by the color filters RCF, GCF, and BCF. In FIG. 6, 'E1' may be an anode (or cathode), and 'E' may be a cathode (or anode). 'E1' is electrically connected to a driving TFT formed on a lower TFT array for each sub-pixel. Each sub-pixel of the TFT array comprises a driving TFT, at least one switching TFT, and a storage capacitor, and each sub-pixel is connected to the data lines 15 and the gate lines 16.

The data driver 12 converts four color compensation data RoGoBoWo whose chromaticity coordinates are compensated, into an analog data voltage, and supplies it to the data lines 15 under the control of the timing controller 11.

The gate driver 13 selects a horizontal line to which a data voltage is applied by generating a scan pulse and sequentially supplying it to the gate lines 16 under the control of the timing controller 11.

The timing controller 11 generates a data control signal DDC for controlling the operation timing of the data drive circuit 12 and a gate control signal GDC for controlling the operation timing of the gate drive circuit 13 based on timing signals such as a vertical synchronization signal Vsync, a horizontal synchronization signal Hsync, a dot clock signal DCLK, and a data enable signal DE.

The timing controller 11 supplies three primary color digital video data RiGiBi input from the outside to the chromaticity coordinate compensation circuit 14, and aligns four color compensation data RoGoBoWo, whose chromaticity coordinates are compensated, from the chromaticity coordinate compensation circuit 14 according to the resolution of the display panel 10 and then supplies it to the data drive circuit 12.

The chromaticity coordinate compensation circuit 14 converts three primary color input digital video data RiGiBi into four color digital video data RoGoBoWo, whose white chromaticity coordinates are compensated in accordance with the characteristics of the white OLEDs and color filters included in each of the pixels P, thereby compensating for deviations in the characteristics of white chromaticity coordinates for each gray level. The chromaticity coordinate compensation circuit 14 may be incorporated in the timing controller 11.

Figures 7, 8:
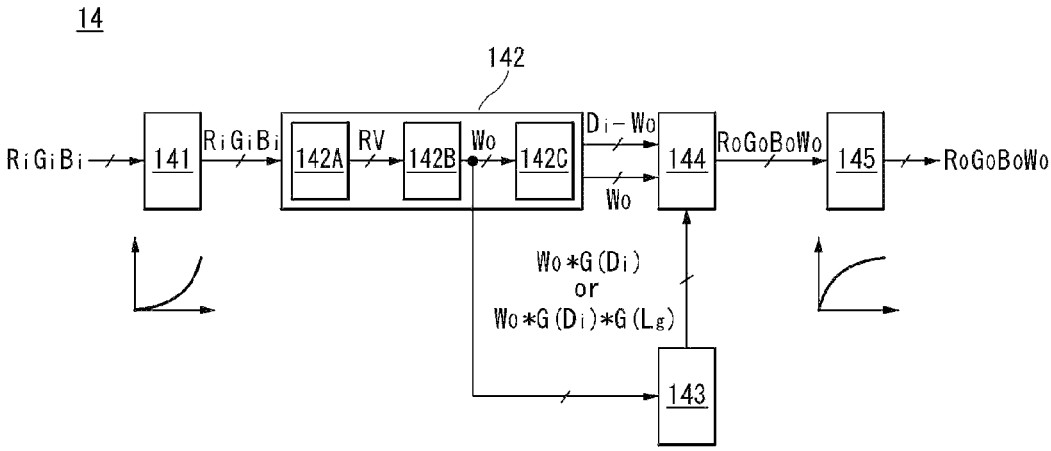
FIG. 7 shows one example of the chromaticity coordinate compensation circuit 14 of FIG. 6.
FIG. 8 shows one example of gain values for each gray level of three primary data for compensating chromaticity coordinates for each gray level.
Figures 9, 10:
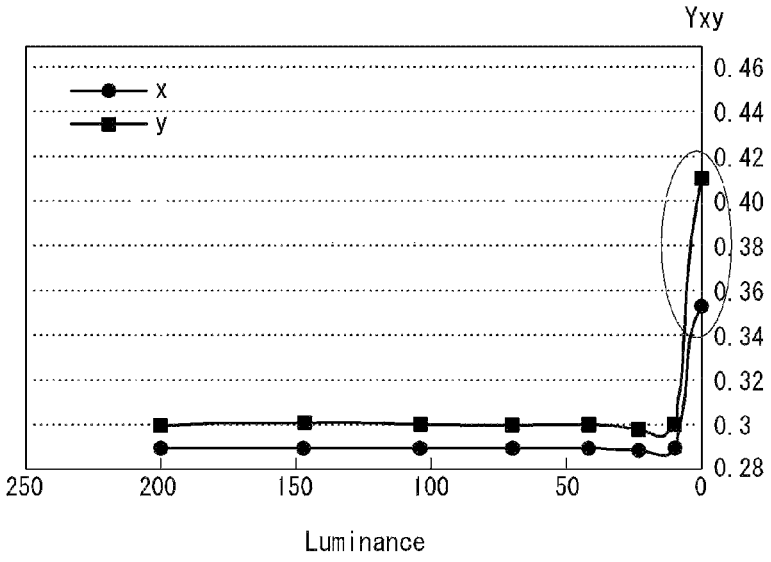
FIGS. 9 to 11 show the result of adjusting chromaticity coordinates for each gray level by applying the gain values of FIG. 8.
Figures 11, 12:
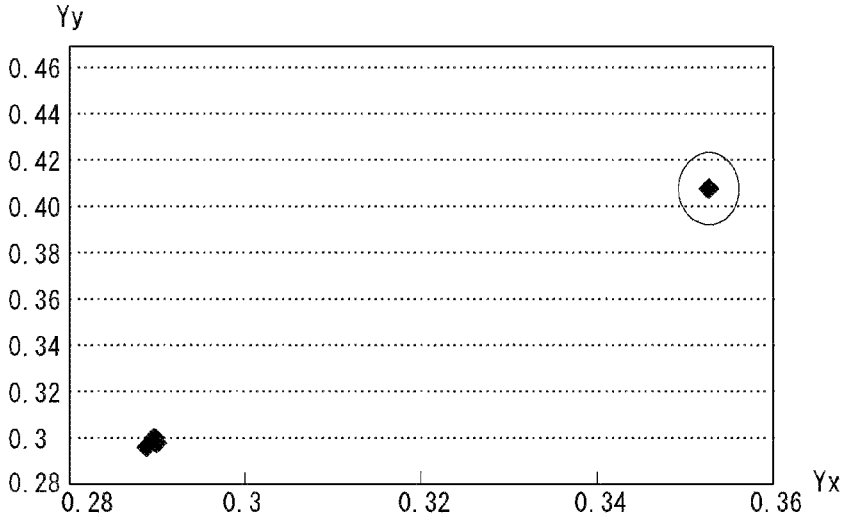
FIG. 12 shows another example of gain values for each gray level of three primary color data for compensating chromaticity coordinates for each gray level.
Figures 13, 14:
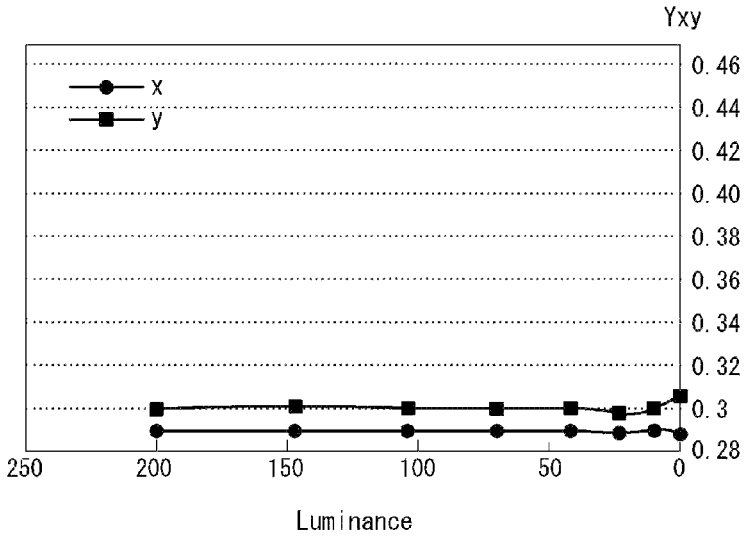
FIGS. 13 to 15 are views showing the result of adjusting chromaticity coordinates for each gray level by applying the gain values of FIG. 12.

FIG. 7 shows one example of the chromaticity coordinate compensation circuit 14 of FIG. 6. FIG. 8 shows one example of gain values for each gray level of three primary data RiGiBi for compensating chromaticity coordinates for each gray level. FIGS. 9 to 11 show the result of adjusting chromaticity coordinates for each gray level by applying the gain values of FIG. 8. FIG. 12 shows another example of gain values for each gray level of three primary color data RiGiBi data for compensating chromaticity coordinates for each gray level. FIG. 13 shows the result of adjusting chromaticity coordinates for each gray level by applying the gain values of FIG. 12.

Referring to FIG. 7, the chromaticity coordinate compensation circuit 14 comprises a first gamma conversion unit 141, a data operation unit 142, a gain adjusting unit 143, a data conversion unit 144, and a second gamma conversion unit 145.

The first gamma conversion unit 141 receives three primary color input data RiGiBi from a system board (not shown), and gamma-converts the input data RiGiBi using any one of preset gamma curves of 1.8 to 2 and then supplies it to the data operation unit 142.

The data operation unit 142 extracts a representative value RV for each pixel based on the gamma-converted three primary color data RiGiBi input from the data operation unit 142, determines white data Wo of the corresponding pixel as the representative value RV, and then subtracts the white data Wo from the gamma-converted three primary color data RiGiBi for each pixel to generate a data operation value Di−Wo (where Di indicates the gamma-converted three primary color data RiGiBi). Then, the data operation value Di−Wo and the white data Wo are output for each pixel. To this end, the data operation unit 142 comprises a representative value extractor 142A, a white data determiner 142B, and a data operation value generator 142C.

The representative extractor 142A applies any one of known algorithms, e.g., four algorithms Alg 1 to Alg. 4 shown in the following Equation 1, to the gamma-converted three primary data RiGiBi to extract a representative value RV for each pixel. In Equation 1, 'Yimin' indicates the gray level value of minimum data among the gamma-converted three primary color data RiGiBi, and 'Yimax' indicates the gray level value of maximum data among the gamma-converted three primary color data RiGiBi. In the application of the first algorithm Alg. 1, the representative value RV for each pixel is defined as 'Yimin'. In the application of the second algorithm Alg. 2, the representative value RV for each pixel is defined as 'Yimin2'. In the application of the third algorithm Alg. 3, the representative value RV for each pixel is defined as '−Yimin3+Yimin2−Yimin'. In the application of the fourth algorithm Alg. 4, if 'Yimin/Yimax' is less than 0.5, the representative value RV for each pixel is defined as '(Yimin*Yimax)/(Yimax−Yimin)', and if 'Yimin/Yimax' is greater than 0.5, the representative value RV for each pixel is defined as 'Yimax'.

[Equation 1]

$$W_o = Y_{imin}: \quad \text{Alg. 1}$$

$$W_o = Y_{imin}^2: \quad \text{Alg. 2}$$

$$W_o = -Y_{imin}^3 + Y_{imin}^2 + Y_{imin}: \quad \text{Alg. 3}$$

$$\begin{cases} W_o = \dfrac{Y_{imin} * Y_{imax}}{Y_{imax} - Y_{imin}} & \text{if } \left(\dfrac{Y_{imin}}{Y_{imax}} < 0.5\right) \\ W_o = Y_{imax} & \text{if } \left(\dfrac{Y_{imin}}{Y_{imax}} \geq 0.5\right) \end{cases}: \quad \text{Alg. 4}$$

Although the first to fourth algorithms Alg. 1 to Alg. 4 may be optionally applied, the first algorithm is more desirable in terms of algorithm size and minimization of a shift of the white chromaticity coordinates. The following description of the exemplary embodiment will be made with respect to the case where the gray level value Yimin of minimum data of the gamma-converted three primary color data RiGiBi is extracted as the representative value RV for each pixel. The technical spirit of the present invention is not limited to the four algorithms Alg. 1 to Alg. 4 exemplified in the above Equation 1. That is, the technical spirit of the present invention is applicable to any known algorithm for extracting the representative value.

The white data determiner 142B determines the white data Wo of the corresponding pixel as the representative value RV, i.e., the gray level value of minimum data for each pixel, input from the representative value extractor 142A.

The data operation value generator 142C generates the data operation value Di−Wo by receiving the white data Wo from the white data determiner 142B and subtracting the white data Wo from the gamma-converted three primary color data RiGiBi for each pixel. The data operation value Di−Wo comprises an R data operation value Ri−Wo, a G data operation value Gi−Wo, and a B data operation value Bi−Wo. The data operation value generator 142C outputs the data operation value Di−Wo and the white data Wo for each pixel.

The gain adjusting unit 143 generates a gain adjusting value of the three primary color data RiGiBi for each gray level (or for each gray level interval) so that the white chromaticity coordinates are not distributed for each gray level but converged to predetermined target values when emitting white light in order to adjust the chromaticity coordinates of a target luminance. To this end, as shown in FIGS. 8 to 12, the gain adjusting unit 143 may refer to a lookup table storing the gain values G(Di) for respective gray levels (or for respective gray level intervals) of the three primary color data RiGiBi. The gain values G(Di) are determined in advance by an experiment so that variations in white chromaticity coordinates for each gray level in accordance with the white data Wo are minimized, i.e., the white chromaticity coordinates are converged to predetermined target values.

In one example, to correspond to the gain value G(Di) set for each gray level interval of the three primary color data RiGiBi as shown in FIG. 8, the gain adjusting unit 143 generates a gain adjusting value Wo*G(Di) by multiplying the gain value G(Di) by the white data Wo from the white data determiner 142B. The gain adjusting value Wo*G(Di) comprises an R data gain adjusting value Wo*G(R), a G data gain adjusting value Wo*G(G), and a B data gain adjusting value Wo*G(B). By the gain adjusting value Wo*G(Di), the chromaticity coordinates (x,y) of the target luminance L in every gray level interval except a low gray level interval 0~31 Gray are converged near to predetermined target values (0.290, 0.300) as shown in FIG. 9. However, even if the maximum possible gain value (e.g., '255' among gain value data consisting of 8 bits) is applied in the low gray level interval 0~31 Gray, convergence to the desired target values (0.290, 0.300) as shown in FIGS. 9 to 11 do not occur.

Figure 15:
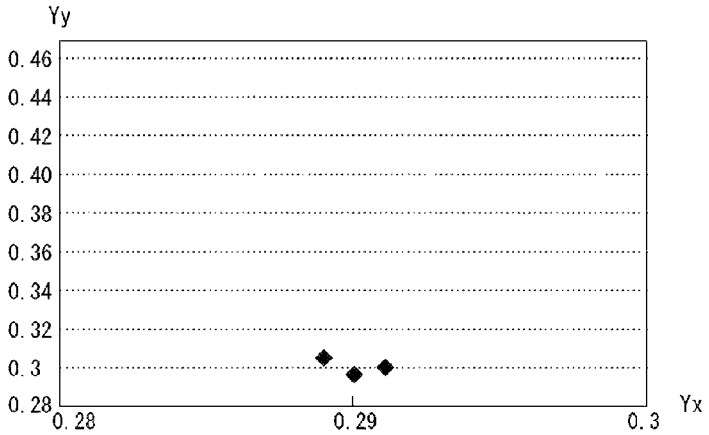

To make up for this problem, it is necessary to increase the gain value of low gray levels by extending the number of bits of the gain value data in the low gray level interval 0~31 Gray. Since the number of bits of white data Wo allocated to the low gray level interval 0~31 Gray is less than 6 bits among the 8 bits, the remaining 2 bits may be additionally allocated to increase the gain value of the low gray levels. FIG. 12 shows a low gray level calibration gain value G(Di)*G(Lg) comprising a gain value increment in the low gray level interval 0~31 Gray in addition to the gain value G(Di) of FIG. 8. The gain value for the low gray level interval 0~31 Gray may increase from '255' of FIG. 8 to '484' of FIG. 12 by additional bit allocation. To correspond to this, the gain adjusting unit 143 generates a calibration gain adjusting value Wo*G(Di)*G(Lg) by multiplying the calibration gain value G(Di)*G(Lg) by the white data Wo from the white data determiner 1423. The calibration gain adjusting value Wo*G(Di)*G(Lg) comprises an R data calibration gain adjusting value Wo*G(R)*G(Lg), a G data calibration gain adjusting value Wo*G(G)*G(Lg), and a B data calibration gain adjusting value Wo*G(B)*G(Lg). By the calibration gain adjusting value Wo*G(Di)*G(Lg), the chromaticity coordinates (x,y) of the target luminance L in every gray level interval except the low gray level interval 0~31 Gray are converged near to predetermined target values (0.290, 0.300) as shown in FIGS. 13 to 15. The gain values shown in FIGS. 8 to 12 may be set to different values as needed depending on the panel condition.

The data conversion unit 144 adds the gain adjusting value Wo*G(Di) (or the calibration gain adjusting value Wo*G(Di)*G(Lg) from the gain adjusting unit 143) to the data operation value Di−Wo from the data operation value generator 142C, and matches the corresponding white data Wo to the three primary color data RoGoBo converted by the adding, thereby generating four color compensation data RoGoBoWo.

The second gamma conversion unit 145 inverse-gamma-converts the four color compensation data RoGoBoWo input from the data conversion unit 144.

Figure 16:
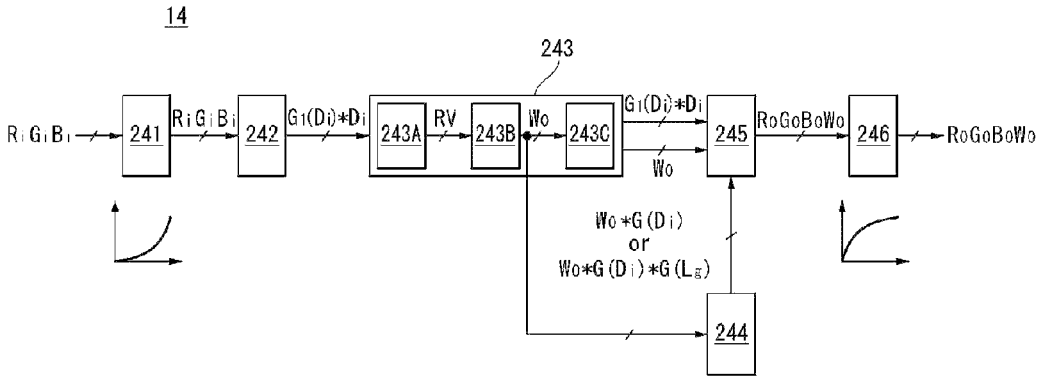
FIG. 16 is a view showing another example of the chromaticity coordinate compensation circuit of FIG. 6.

FIG. 16 shows another example of the chromaticity coordinate compensation circuit 14 of FIG. 6.

Referring to FIG. 16, the chromaticity coordinate compensation circuit 14 comprises a first gamma conversion unit 241, a first gain adjusting unit 242, a data operation unit 243, a second gain adjusting unit 244, a data conversion unit 245, and a second gamma conversion unit 246.

The chromaticity coordinate compensation circuit 14 of FIG. 16 further comprises the first gain adjusting unit 242 unlike that of FIG. 7.

The first gain adjusting unit 242 primarily compensates the white chromaticity coordinates of the three primary color data RiGiBi by multiplying a preset first gain value G1(Di) for each gray level (or for each gray level interval) by the gamma-converted three primary color data RiGiBi so that the white chromaticity coordinates are not distributed for each gray level but converged to predetermined target values when emitting white light in order to adjust the chromaticity coordinates of a target luminance. To this end, the first gain adjusting unit 242 may refer to a lookup table storing the first gain values G1(Di) for respective gray levels (or for respective gray level intervals) of the three primary color data RiGiBi. The first gain values G1(Di) are determined in advance by an experiment so that variations in white chromaticity coordinates for each gray level in accordance with the white data Wo are minimized, i.e., the white chromaticity coordinates are converged to predetermined target values.

The first gamma conversion unit 241, data operation unit 243, second gain adjusting unit 244, data conversion unit 245, and second gamma conversion unit 246 of FIG. 16 respectively correspond to the first gamma conversion unit 141, data operation unit 142, gain adjusting unit 143, data conversion unit 144, and second gamma conversion unit 145 of FIG. 7. The functions and operations of the corresponding components 241, 243, 244, 245, and 246 of FIG. 16 are substantially identical to those as described above through FIGS. 7 to 15 except that three primary color data RiGiBi, multiplied by the first gain value G1(Di), is input into the data operation unit 243 and a data operation value G1(Di)*Di−Wo, to which the first gain value G1(Di) is applied, is input into the data conversion unit 245.

As described above in detail, the organic light emitting diode display and the method for compensating the chromaticity coordinates thereof according to the present invention can greatly improve picture quality by compensating for deviations in the characteristics of white chromaticity coordinates for each gray level in the organic light emitting diode display comprising a white OLED From the above description, it will be apparent to those skilled in the art that various changes and modifications can be made without departing from the technical spirit of the present invention. Accordingly, the scope of the present invention should not be limited by the exemplary embodiments, but should be defined by the appended claims.

What is claimed is:

1. An organic light emitting diode display, comprising:

a display panel on which a plurality of pixels are arranged, each of the pixels comprising an R sub-pixel for generating red light through a white OLED and an R color filter, a G sub-pixel for generating green light through a white OLED and a G color filter, a B sub-pixel for generating blue light through a white OLED and a B color filter, and a W sub-pixel for generating white light through a white OLED;

a data operation unit for generating a data operation value by extracting a representative value for each pixel based on three primary color data, determining white data of the corresponding pixel as the representative value, and then subtracting the white data from the three primary color data for each pixel;

a gain adjusting unit for generating a gain adjusting value of the three primary color data by multiplying a preset gain value of the three primary color data by the corresponding white data; and a data conversion unit for generating four color compensation data, whose white chromaticity coordinates are compensated for each pixel, by adding the gain adjusting value to the data operation value and matching the corresponding white data to the three primary color data converted by the adding, wherein the preset gain value is defined as a value for converging white chromaticity coordinates for each gray level or for each gray level interval to a predetermined target value in accordance with the white data.

2. The organic light emitting diode display of claim 1, wherein the gain adjusting unit generates a gain adjusting value for each gray level or for each predetermined gray level interval with reference to the gain value set for the gray level or for the gray level intervals.

3. The organic light emitting diode display of claim 1, wherein the representative value is extracted as the gray level value of minimum data of the three primary color data.

4. The organic light emitting diode display of claim 1, wherein, in a predetermined low gray level interval, the number of bits of the gain value data becomes larger than the number of bits of representable data.

5. The organic light emitting diode display of claim 4, wherein the remaining bits of the white data after allocation to the low gray level interval are additionally allocated to increase the gain value in the low gray level interval.

6. The organic light emitting diode display of claim 1, wherein the gain adjusting unit primarily compensates the white chromaticity coordinates of the three primary color data by multiplying preset gain values by the three primary color data, and supplies the same to the data operation unit.

7. The organic light emitting diode display of claim 1, further comprising a gamma conversion unit for gamma-converting the three primary color data using a preset gamma curve and outputting the same to the data operation unit, and for inverse-gamma-converting and outputting the four color compensation data.

8. A method for compensating the chromaticity coordinates of an organic light emitting diode display comprising a plurality of pixels are arranged, each of the pixels comprising an R sub-pixel for generating red light through a white OLED and an R color filter, a G sub-pixel for generating green light through a white OLED and a G color filter, a B sub-pixel for generating blue light through a white OLED and a B color filter, and a W sub-pixel for generating white light through a white OLED, the method comprising:

generating a data operation value by extracting a representative value for each pixel based on three primary color data, determining white data of the corresponding pixel as the representative value, and then subtracting the white data from the three primary color data for each pixel;

generating a gain adjusting value of the three primary color data by multiplying a preset gain value of the three primary color data by the corresponding white data; and generating four color compensation data, whose white chromaticity coordinates are compensated for each pixel, by adding the gain adjusting value to the data operation value and matching the corresponding white data to the three primary color data converted by the adding, wherein the preset gain value is defined as value for converging the white chromaticity coordinates for each gray level or for each gray level interval to predetermined target value in accordance with the white data.

9. The method of claim 8, wherein the generating a gain adjusting value generates gain adjusting values for respective gray levels or for respective preset gray level intervals with reference to the gain values set for the respective gray levels or for the respective gray level intervals.

10. The method of claim 8, wherein the representative value is extracted as the gray level value of minimum data of the three primary color data.

11. The method of claim 8, wherein, in a predetermined low gray level interval, the number of bits of the gain value data becomes larger than the number of bits of representable data.

12. The method of claim 11, wherein the remaining bits of the white data after allocation to the low gray level interval are additionally allocated to increase the gain value in the low gray level interval.

13. The method of claim 8, further comprising, prior to the generating of the data operation value, primarily compensating the white chromaticity coordinates of the three primary color data by multiplying a preset first gain value by the three primary color data, and supplying the same to a data operation unit.

14. The method of claim 8, further comprising, prior to the generating of the data operation value, gamma-converting the three primary color data using a preset gamma curve and outputting the same to a data operation unit, and for inverse-gamma-converting and outputting the four color compensation data.

* * * * *